US005337654A

United States Patent [19]

Broberg et al.

[11] Patent Number: 5,337,654

[45] Date of Patent: Aug. 16, 1994

[54] PORTABLE OVEN AIR CIRCULATOR

[75] Inventors: Daniel M. Broberg, Edina; Glenn Campbell, Sr., Plymouth; Paul Varley, Dundos, all of Minn.

[73] Assignee: Northland Aluminum Products, Inc., Minneapolis, Minn.

[21] Appl. No.: 875,994

[22] Filed: Apr. 29, 1992

[51] Int. Cl.[5] ..... A47J 36/38

[52] U.S. Cl. ..... 99/447; 99/474; 126/21 A

[58] Field of Search ..... 99/447, 473, 474; 126/21 A, 21 R

[56] References Cited

U.S. PATENT DOCUMENTS

| | | | |
|---|---|---|---|
| 2,412,103 | 6/1944 | Spooner . | |
| 2,957,067 | 8/1958 | Scofield . | |
| 3,168,642 | 1/1963 | Savio . | |
| 3,246,690 | 4/1966 | Fry | 126/21 A |
| 3,379,189 | 8/1966 | Staples . | |
| 3,529,556 | 9/1970 | Barnes | 99/447 |
| 3,529,582 | 9/1970 | Hurko | 126/21 A |
| 3,812,837 | 5/1974 | Takase . | |
| 4,369,760 | 1/1983 | Jorgensen et al. . | |
| 4,375,184 | 3/1983 | Gilliom | 99/447 |
| 4,434,343 | 2/1984 | Bowen et al. | 99/443 R |
| 4,456,805 | 6/1984 | Jorgensen et al. | 99/443 R |
| 4,457,292 | 7/1984 | Jorgensen et al. . | |
| 4,687,908 | 11/1987 | Thorne . | |
| 4,694,132 | 9/1987 | Liu | 99/443 R |
| 4,746,781 | 5/1988 | Dalquist et al. | 99/443 R |
| 4,788,397 | 11/1988 | Danley | 99/443 R |
| 4,817,509 | 4/1989 | Erickson | 99/447 |
| 4,886,948 | 12/1989 | Pomroy et al. | 99/443 R |

*Primary Examiner*—Chris K. Moore
*Assistant Examiner*—James F. Hook
*Attorney, Agent, or Firm*—Haugen and Nikolai

[57] ABSTRACT

A portable air cooking apparatus for use in cooking ovens to create air currents which transfer heat to cooking food stuffs to promote more rapid and more uniform cooking or baking as described. The portable air circulating apparatus is intended to sit on the top cooking rack of a conventional oven and blow air down on food being cooked beneath it on the lower rack.

8 Claims, 4 Drawing Sheets

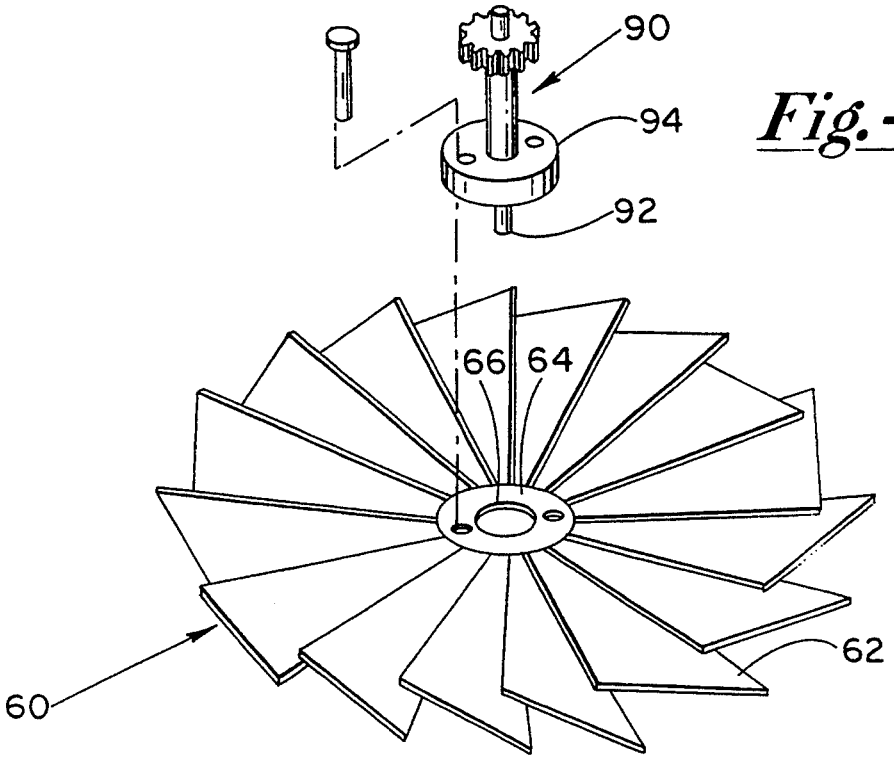
Fig.-4
Fig.-5
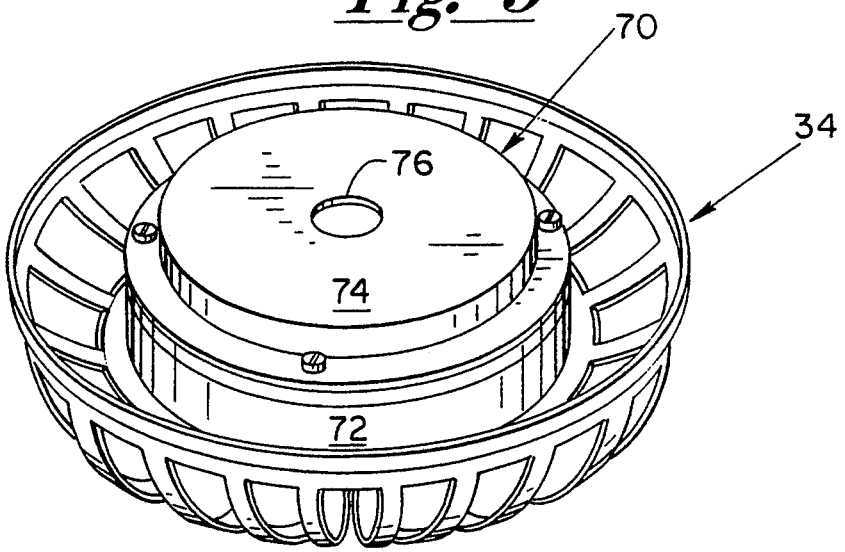

200
34
36
72
112
110
108
102
106
100
104
134
144
140
143
136
130
136
142
146
148
132
150
150
74
60
98
90
60
32

PORTABLE OVEN AIR CIRCULATOR

The present invention relates to forced convection cooking in gas or electric ranges. More specifically, the invention relates to a spring motor powered fan which is designed to sit on the top cooking rack of an oven and blow air downwardly over food being cooked on a lower rack or racks.

BACKGROUND OF THE INVENTION

For many years it has been recognized that heating of materials within an oven enclosure will be more uniform and rapid if forced circulation of the air within the oven is employed rather than relying on air currents created by temperature differences. Early recognition of this concept is found in U.S. Pat. No. 2,412,103 to Spooner and U.S. Pat. No. 2,957,067 to Skofield.

Most gas and electric ranges used in homes today are not equipped with an air handling device to force an air current. Instead, air circulates within these ovens strictly by means of temperature differences in the oven. These currents may not be uniform within the oven because air is a particularly poor conductor of heat. Such currents may also change as pans and trays are added. Further, these currents cannot exist without certain parts of the oven chamber being hotter than others.

Various patents do exist which disclose ovens with forced air circulation mechanisms built in. Examples include U.S. Pat. No. 3,168,642 to Savio and U.S. Pat. No. 3,812,837 to Tadayoshi. These systems include driving motors disposed outside of the oven interior and are not adapted for use with ovens not so equipped by the original manufacturer.

In the early 1980s, two patents were issued to the assignee of the present invention which relate to portable oven air circulators. These patents are U.S. Pat. No. 4,369,760 and U.S. Pat. No. 4,457,292, both to Jorgenson et al. These patents disclose a portable air circulator for use in cooking ovens which includes a blade, housing, spring motor, gear train and a large flat horizontal oven rack clamp which served as a base for the air circulator. While this design did provide certain positive benefits, the configuration did not provide all of the positive effects of the present invention. First, because the design blew the air across the food rather than down over the food, one side of the food would cook at a faster rate than the other side. Also, the container in which the food was being cooked would often disrupt and interfere with proper air flow reducing the effectiveness of the design. Finally, the housing design shown in these earlier patents reduce the efficiency of the fan in circulating the air.

More recently, U.S. Pat. No. 4,687,908 issued to Kenneth W. Thorn. The Thorn patent discloses a portable fan powered by an electric motor. The convection blower disclosed in Thorn is designed to sit on the floor of the oven between the heating elements and blow the air upwardly. The patent also described means for electrically energizing the motor using the electrical connector of the oven's heating element. This is a high voltage and complicated connection which may present certain safety hazards and difficulties in making the proper connections. The motor only operates to run the blower when the heating element of the electric oven is on. Thus, the design shown in Thorn cannot operate continuously in an electric oven. It also cannot be used in gas ovens. Further, because the device is located on the floor of the oven, it suffers from the problem of blowing air at the bottom of the cookware or bakeware being used rather than blowing air over the food being cooked.

As an improvement over this art, the present invention provides a portable oven air circulator which can be used in both gas and electric ovens to blow air from above down from over the food so as to produce optimal circulation in the cooking oven.

SUMMARY OF THE INVENTION

A primary object of the present invention is to provide a self enclosed and motorized portable oven air circulator which may be energized and placed within an oven to produce a mechanically forced air current in the oven during the cooking process.

Another object of the invention is to provide a portable oven-air circulator which may be used in both gas and electric ovens at all normally used cooking, basting and roasting temperatures.

Still another object in the invention is to provide a portable oven air circulator for use in cooking ovens which will blow air down from the top of the oven over the food rather than from the side across the food or the bottom toward a container holding the food.

Yet another object of the invention is to provide a portable oven air circulator for use in cooking ovens which is durable, economical to manufacture and relatively easy to operate, keep clean and store.

Still another object of the invention is to provide a portable oven air circulator for use in cooking ovens to circulate the air in such a fashion so as to produce relatively constant, uniform and rapid cooking.

These and other objects of the invention will become more clear from a reading of the following description of the preferred embodiment in view of the accompanying drawings.

BRIEF DESCRIPTION OF THE DRAWINGS

FIG. 4 is a perspective view of the fan blade and fan drive of the oven air circulator of the preferred embodiment.

FIG. 5 is a perspective view showing the underside of the cover and the inner housing of the oven air circulator of the preferred embodiment.

DESCRIPTION OF THE PREFERRED EMBODIMENT

Figure 1:
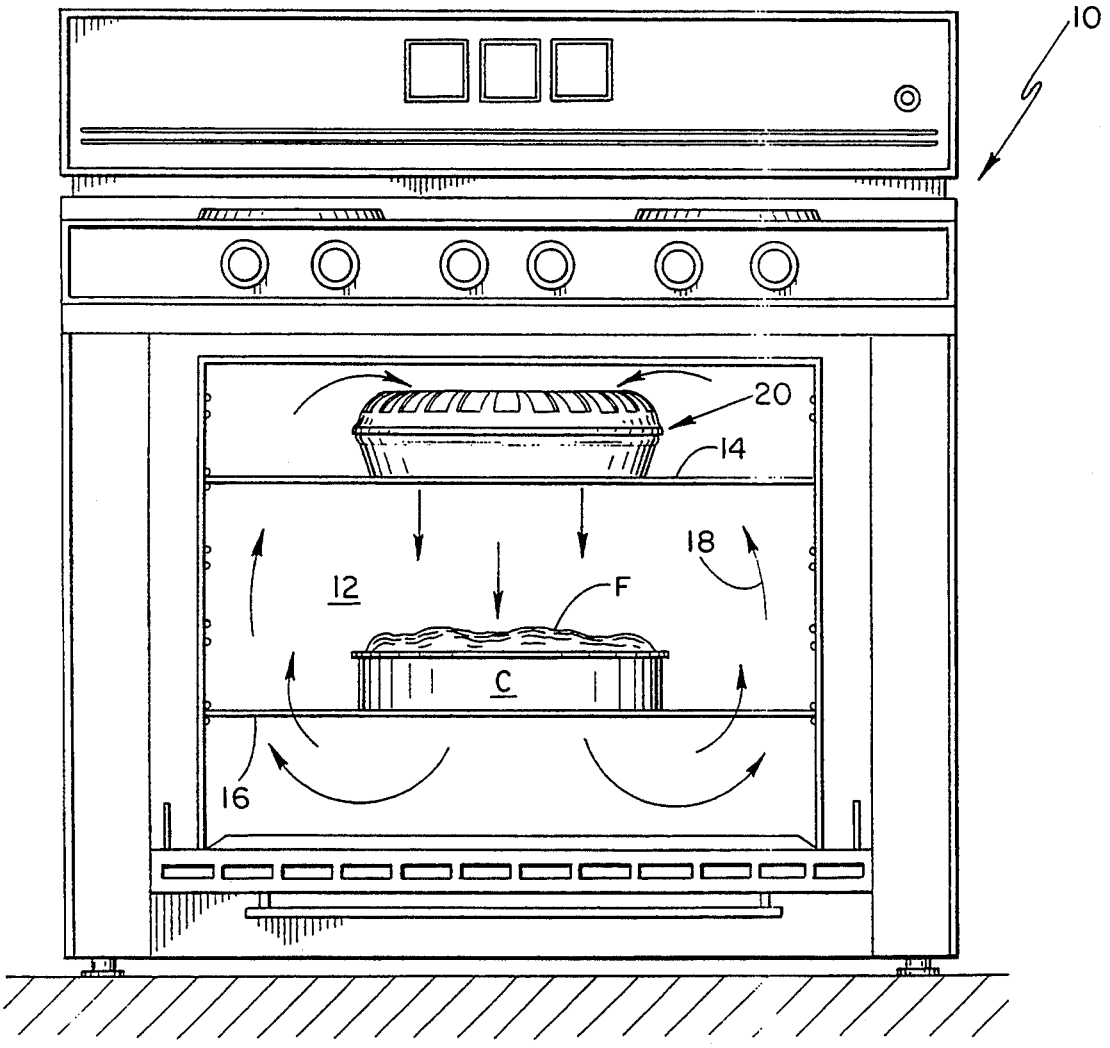
FIG. 1 is a front view of an oven with the door open to show the air circulator of the present invention on the upper shelf and a container for the food to be cooked on a lower shelf.

In FIG. 1, the numeral 10 denotes the walls surrounding a conventional oven chamber 12. Shown within the oven chamber is a top oven rack 14 and a bottom oven rack 16. A container C is positioned a lower oven rack 16. The food F to be cooked is contained within the container C.

The improved portable oven air circulator which forms the subject of the present invention is designated generally by the numeral 20. All parts of portable oven air circulator are made of a material, such as a metal, which is both heat resistant and dishwasher safe so that the device will not be damaged by the heat of the oven or by washing it in a dishwasher. In FIG. 1, the air circulator 20 is shown sitting on the top oven rack 14 at the center. Arrows are present to indicate the air flow generated by the air circulator 20. The circulator 20 is positioned in a generally horizontal orientation upon top oven rack 14 and blows air down through the top oven rack 14 and over the food F in container C.

Figure 2:
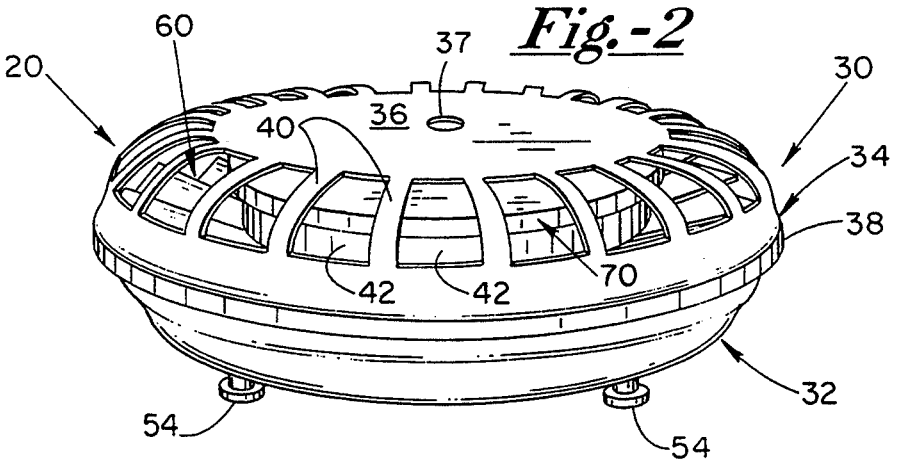
FIG. 2 is a perspective view of the oven air circulator of the preferred embodiment.

FIG. 2 shows various elements of the air circulator 20 in perspective view. Circulator 20 includes an outer housing designated generally by the numeral 30. The housing includes a base 32 and a cover 34. The cover 34 has a round, flat central support member 36, a peripheral rim 38, a plurality of bridging members 40, and air intake openings 42 between the bridging members 40. Located at the center most point of the central support member 36 is an annular opening 37. Visible through the air intake openings 42 is a portion of the inner housing 70 which projects downwardly from and is secured to the central support 36 of the cover 34. Also partially visible through the air intake openings 42 is a portion of fan blade 60. Fan blade 60 rotates within the enclosure formed by the base 32 and the cover 34 between the inner housing 70 and the base 32.

Figure 3:
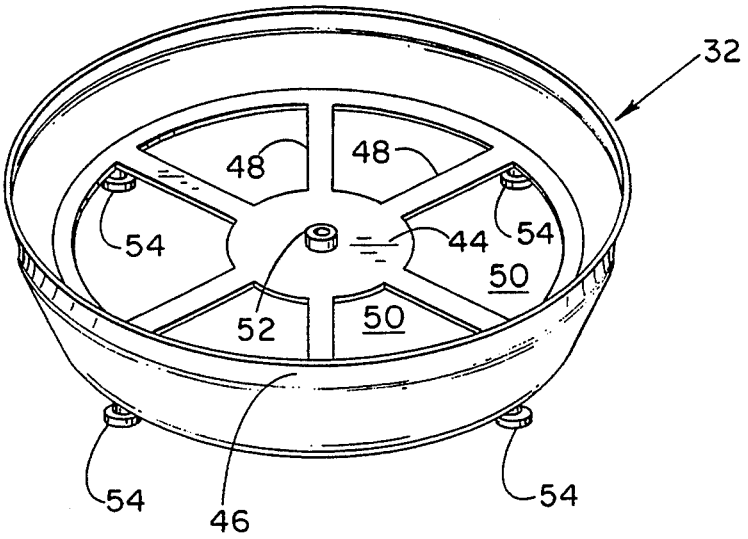
FIG. 3 is a perspective view of the base of the oven air circulator of the preferred embodiment.
Figure 3A:
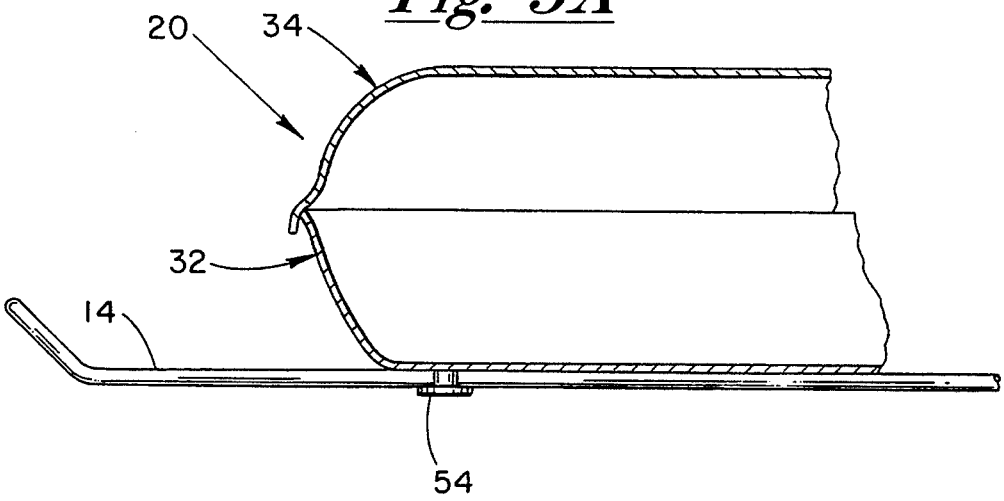
FIG. 3*a* is a partial cross section of the base and cover of the oven air circulator sitting on an oven rack.

The structure of the base 32 is shown in greater detail in FIG. 3. The base 32 also includes a central support member 44, a peripheral rim 46, and a plurality of bridging members 48. Air outlet openings 50 are located between the bridging members 48. Located at the center of the central support 44 is a bearing 52 which projects upwardly from the base. Associated with the base and projecting downwardly therefrom are feet 54 which are T-shaped in cross section. As shown in FIG. 3*a*, these T-shaped feet are designed to engage the spaces in the top oven rack 14 so that the base 32, itself, sits on the rack 14 and the T-shaped feet 54 lock the air circulator 20 to rack 14.

When the air circulator 20 is fully assembled, the peripheral rim 38 of the cover is mated to the peripheral rim 46 of the base as shown in FIG. 2. The peripheral rims 38 and 46 can be held together using a variety of means. Examples include a threaded connection, the use of screws, rivets or the like, or welding or crimping the two rims together.

FIGS. 4, shows an example of a fan blade 60 which could be used. It includes a set of vanes 62 and a central mounting plate 64 with a bore 66. The bore 66 permits a terminal 92 portion of the fan drive member 90 to pass through the central mounting plate 64. The terminal portion 92 of fan drive member 90 is specifically journaled to mate with and rotate within bearing 52 of the base 34.

The fan drive member 90 can be fixed to the central mounting plate 64 in any of a variety of conventional ways. For example, the fan drive member 90 could include a mounting plate 94 which projects at a right angle from the axis of rotation 96 of the fan drive member 90 so that the mounting plate 94 of the fan drive member 90 is in face to face registration with the central mounting plate 64 of the fan blade 60. Screws, rivets or the like could then be used to hold the mounting plates 64 and 94 together. Alternatively, the fan drive member 90 could be integrally formed with the fan blade 60.

FIG. 5 is a bottom view of the cover 34 with the inner housing 70 mounted to it. As shown in the drawing, the inner housing 70 has a generally cylindrical shaped sleeve 72. The diameter of sleeve 72 is approximately the same as the central support member 36 of cover 34 and is secured thereto. The inner housing 70 also includes a cover plate 74 which cooperates with the cylindrical sleeve 72 and the central support member 36 to form an enclosure. Located at the center of the cover plate 74 is a round aperture 76. Aperture 76 is sized to receive the fan drive member 90 and to permit the fan drive member to easily rotate.

Figure 6:
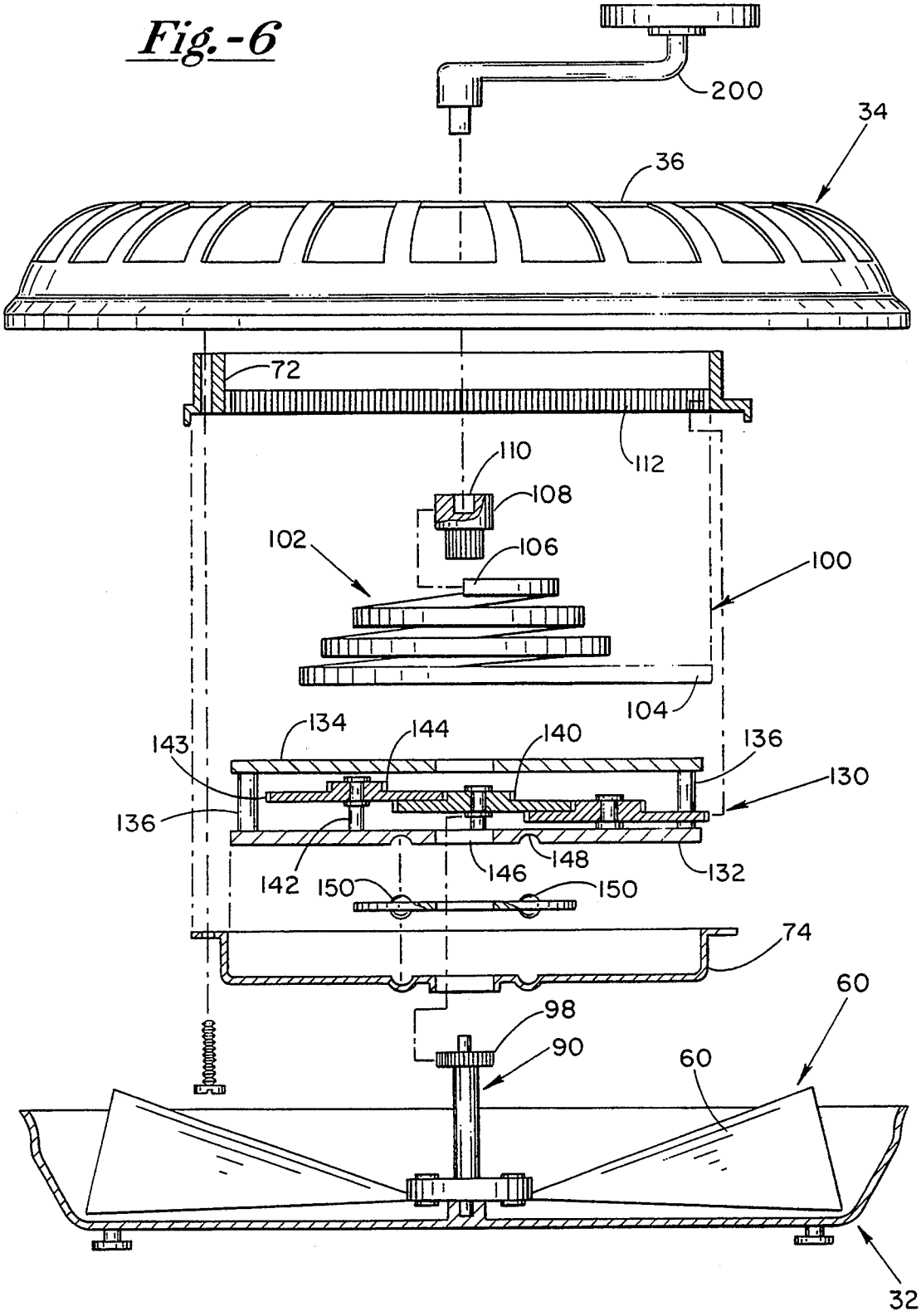
FIG. 6 is an exploded view in partial section showing how the various parts of the air circulator of the present invention are assembled.

FIG. 6 shows how the various elements are assembled. The inner housing contains a spring motor 100 and a gear train 130. The motor 100 and gear train 130, in combination with the fan drive member 90, cooperate to turn the fan blade 60. As explained in greater detail below, the gear train 130 and the fan drive member 90 act as a power transmission which cooperates with the spring motor 100 to cause the fan blade 60 to rotate at a rate faster than the output of the spring motor 100.

The spring motor 100 includes a long flat spring 102 having ends 104 and 106. End 104 of spring 102 is securely fastened to the cylindrical sleeve 72 of the inner housing 70. End 106 of spring 102 is securely fastened to a clutch 108. The clutch 108 includes a socket 110 which is positioned in alignment with the opening 37 in the center of central support member 36 and is secured to the central support member 36 at this location in a manner which permits rotational movement around an axis perpendicular to the plane of central support member 36. The socket 110 and the opening 37 permit insertion of a handle member 200. Handle member 200 can then be used to rotate the clutch 108 causing the spring to be wound around the clutch. The clutch is designed to only permit rotation in a single direction. The spring motor also includes gear teeth 112 around the inner wall 114 of the cylindrical sleeve 72 of the inner housing 70.

The gear train assembly has a first plate 132 and a second plate 134. The two plates 132 and 134 are in face to face registration but are held separated by a plurality of spacers 136. The plates 132 and 134 have a series of aligned bearing recesses. Located between the two plates are gears 140. Each gear includes an axle 142. Mounted on each axle are a pair of teethed gear wheels 143 and 144. The gear wheels 143 are substantially larger than gear wheels 144. The axles 142 are journaled for rotation within the bearing recesses. The bearing recesses are positioned on plates 132 and 134 and the gear wheels 143 and 144 are positioned in the axles 142 so that gears 140 cooperates to increase the rotational speed of the output of gear train 130.

The first plate 132 also includes a central bore 146 therethrough. Bore 146 is designed to receive the geared end 98 of the fan drive member 90 and permit rotation of the drive member 90. The geared end 98 of the fan drive member 90 is designed to mesh with the last gear 140 of the gear train 130. The first plate 132 also includes a raceway 148 which surrounds bore 146. The raceway is designed to receive ball bearings 150 which assist in permitting rotational movement of the entire gear train assembly 130 with respect to the cover plate 74 of the inner housing. The second plate 134 includes means at its center for securing it to the clutch 108.

When the device is fully assembled, the spring is wound around the clutch 108, and the clutch is engaged, the force of spring 102 will cause the clutch to rotate the entire gear train assembly 130 within the inner housing 70. As this rotation occurs, the motor gear teeth 112 will mesh with the teeth the first gear 140 of the gear train assembly causing all of the gears included in the gear train assemble to rotate. Because the geared end 98 of the fan drive member 90 is designed to mesh with the last gear of the gear train, the fan drive member 90 and the fan blade 60 will also spin. In fact, the presence of the gear train assembly 130 will cause the fan blade 60 to spin at a rate approximately 400 times faster than the rate at which the spring motor 100 is rotating the gear train assembly 130. Of course, because the fan blade 60 serves as a governor controlling the speed of the system, the use of fan blades of differing designs will result in different air flow patterns, speed of rotation, and run time.

Use of the compact portable air circulator of the present invention will now be described. Its design allows it to be placed upon the top cooking rack of the oven. The T-shaped feet slip through the openings in the rack and lock the air circulator in place. The rack can be slid in or out of the oven door in the normal fashion even with the air circulator in place.

When use of the air circulator 20 is desired, the rack can be slid forward through to oven door and the handle 200 can be inserted into the socket 110. The handle 200 is then used to wind the spring motor without rotation of either the gear train 130 or the fan blade 60. After the spring motor 100 is wound, the handle is removed. Energy released from the spring 102 causes the clutch 108 to rotate. This rotational movement is transferred from the clutch 108 to the gear train assembly 130. As the entire gear train assembly 130 is rotated, the motor gear teeth 112 cause the four gears of the gear train assembly 130 to rotate and impart rotational movement to the fan drive member 90 and the fan blade 60. The fan blade 60 rotates at a rate approximately 400 times that of the gear train assembly itself.

Rotation of the fan blade causes air to be drawn in through the air intake openings 32 and out of the air outlet openings 50 as shown by the arrows 18 in FIG. 1. This circulation of air promotes more rapid, more uniform, and more efficient cooking of food. The outer layer of the food is seared more quickly thereby trapping the juices to provide improved flavor.

While the preferred embodiment of the present invention has been shown and described, it will be understood that this description in the illustrations provided are offered merely by way of example, and that the invention is to be limited in scope only by the appended claims.

We claim:

1. A heat resistant compact portable air circulator for use in a cooking oven to increase the rate and uniformity of cooking and baking which comprises:

a. an outer housing having a base and a cover, both including a plurality of openings through which air can pass, b. an inner housing within said outer housing and secured thereto, said inner housing having an aperture therethrough, c. a fan blade located within the outer housing and outside the inner housing, said fan blade designed to draw air in through the openings in the cover of the outer housing, around the outside of the inner housing, and expel the air through the openings in the base of the outer housing, d. a spring motor within said inner housing, said spring motor having output means connected to a power transmission so that the spring motor and power transmission cooperate to cause the fan blade to rotate at a rate faster than the output means of the spring motor, and e. means for energizing the spring motor.

2. The compact portable air circulator of claim 1 wherein said spring motor includes a long flat spring having a first end and a second end, the first end of said spring secured to said second housing.

3. The compact portable air circulator of claim 2 wherein the output means of the spring motor includes engageable clutch means and gear means on the second housing.

4. The compact portable air circulator of claim 3 wherein said engageable clutch means is attached to the second end of the long flat spring and to the power transmission means.

5. The compact portable air circulator of claim 3 wherein the means for energizing the spring motor includes a handle which mates with a socket in the clutch means so that turning the handle causes the spring to be wound about the clutch means without such rotational movement being imparted to the power transmission means.

6. The compact portable air circulator of claim 1 or claim 5 wherein said power transmission means comprises a gear train having a first plate, a second plate with a central bore therethrough, and a plurality of rotatable gear elements located between said first and second plates, and a drive member which passes through the central bore of the second plate of the gear train and the aperture of said second housing, said drive member having a pair of ends, one of which is attached to the fan blade and the other of which is attached to a gear of said gear train.

7. The compact portable air circulator of claim 6 wherein the gear means on the second housing mesh with a gear of the gear train as the gear train is rotated by the clutch means as energy is release from the spring so that the gears of the gear train are also rotated relative to the first and second plates of the gear train.

8. The compact portable air circulator of claim 1 further including a plurality of feet projecting downwardly from the base which engage the oven rack.

* * * * *